US005585614A

United States Patent [19]

VonBallmoos

[11] Patent Number: 5,585,614

[45] Date of Patent: Dec. 17, 1996

[54] ACCESS CONTROL DEVICE

[75] Inventor: Fritz VonBallmoos, Horgen, Switzerland

[73] Assignee: Dr. VonBallmoos AG, Switzerland

[21] Appl. No.: 410,385

[22] Filed: Mar. 27, 1995

Related U.S. Application Data

[63] Continuation of Ser. No. 25,307, Mar. 2, 1993, abandoned, which is a continuation of Ser. No. 634,206, Jan. 24, 1991, abandoned.

[30] Foreign Application Priority Data

May 18, 1989 [CH] Switzerland ..... 1853/89
May 17, 1990 [WO] WIPO ..... PCT/CH90/00130

[51] Int. Cl.[6] ..... G06K 5/00

[52] U.S. Cl. ..... 235/382; 235/375; 235/380; 235/492

[58] Field of Search ..... 235/375, 380, 235/382, 492

[56] References Cited

U.S. PATENT DOCUMENTS

| | | | |
|---|---|---|---|
| 4,036,178 | 7/1977 | Lee | 119/51 |
| 4,236,068 | 11/1980 | Walton | 235/380 |
| 4,353,064 | 10/1982 | Stamm | 235/380 |
| 4,384,288 | 5/1983 | Walton | 235/380 |
| 4,388,524 | 6/1983 | Walton | 235/380 |
| 4,459,474 | 7/1984 | Walton | 235/380 |
| 4,473,825 | 9/1984 | Walton | 235/380 |
| 4,510,495 | 4/1985 | Sigrimis | 340/825.54 |
| 4,600,829 | 7/1986 | Walton | 235/492 |
| 4,918,296 | 4/1990 | Fujisika | 235/375 |
| 4,918,416 | 4/1990 | Walton et al. | 235/492 |
| 5,175,418 | 12/1992 | Tanaka | 235/492 |

*Primary Examiner*—Harold Pitts
*Attorney, Agent, or Firm*—Handal & Morofsky

[57] ABSTRACT

This access control device has at least one local control device (10) connected to a central control device (11) containing a local computer (18), an issuing station (12) for control cards and a lockable entry installation (13). At the issuing station (12) are issued portable control cards (47) with an electronic identity number is stored at each issue. A transmitting device 921) fitted at the entry installation (13) transmits a continuous series of signals corresponding to identity numbers recognized by the local computer (18) as valid. As soon as the comparator circuit finds a correspondence between transmitted and stored identity numbers, the transmission circuit of the control card is activated to send a release signal to open the entry installation, whereby the power to transmit the release signal is taken from the signals transmitted by the transmission device.

9 Claims, 2 Drawing Sheets

ACCESS CONTROL DEVICE

This application is a Continuation of application Ser. No. 08/025,307, filed 2 Mar. 1993, now abandoned, which was a continuation of 07/634,206 filed Jan. 24, 1991, now abandoned.

TECHNICAL FIELD

The present invention relates to an access control device including a local control device that contains an HF receiver which, upon receipt of a pre-settable signal, causes the opening of a locking mechanism and that cooperates with a portable control card to which an individual identification number is assigned and which contains an HF transmitter.

BACKGROUND

Access control devices of the above-cited kind are preferably used in large service or industrial installations having different departments that should be accessible to only a defined group of persons. In such devices, each authorized person is assigned an individual identification number which is broadcast continuously when the portable transmitter is switched on. A locally fixed receiver has a memory containing the identification numbers of the authorized persons and also has a comparator circuit that generates an output signal when a received ID number corresponds to a stored ID number. This output signal causes the opening of the locking mechanism to admit one person.

Such devices require a relatively complicated portable transmitter whose carrier frequency is modulated with the individual ID number and they do not operate with the desired reliability under all external conditions because the voltage of the battery that supplies the current for the portable transmitter is highly temperature-dependent. Hence, these devices are not suitable for controlling access to installations where the authorized persons change daily or even several times on the same day nor to installations whose entrances are subjected to low temperatures, especially in the winter.

Accordingly, it is the object of the present invention to create an access control device with a portable HF transmitter that is of simple construction, is powered by a temperature-independent current source and can be made no cheaply, even including its auxiliary parts, as to be suitable for only a single use.

This object is attained, according to the invention, by using an access control device of the type described at the outset but characterized in that the local control device includes a local computer in which all valid control codes are stored as well as an HF transmitter whose carrier wave is modulated with the continuous sequence of valid ID numbers and further characterized in that the portable control pass includes an electronic memory storing the ID number assigned to the control card, as well as a comparator circuit and an HF transmitter which sends out a recognition signal when the comparator determines correspondence between the assigned ID number and an ID number from the sequence of ID numbers transmitted by the HF transmitter of the control device, the recognition signal being fed from the HF transmitter of the control device to the local computer which controls the locking mechanism.

In a preferred embodiment of the control device, the portable control pass contains a current supply circuit which converts the energy received from the HF transmitter of the local control device into the DC current required for the operation of the circuit elements of the control card.

The access control device according to the invention is especially suitable for use in recreation sites and, for example, in regional skiing centers that include several closable site entrances or partial site entrances, each of which cooperates with an associated local computer.

The control pass used with the access control device according to the invention can be made cheaply because it contains only simple electronic circuits and components and sends out an un-modulated signal, all complicated and expensive circuits being associated with the locally fixed transmitter. Moreover, a valid pass permits unhindered passage through the locking mechanism because the locally fixed transmitter and receiver cooperate with the receiver and transmitter of the control pass without any action by the control pass bearer.

BRIEF DESCRIPTION OF THE DRAWINGS

Following is a description of a preferred embodiment of the access control device according to the invention, referring to the figures of the drawing.

[THE DRAWING]

Figure 2:
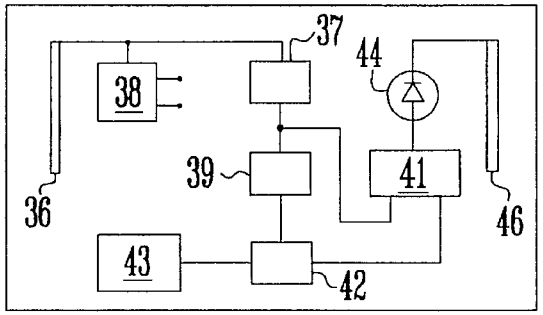
Figure 1:
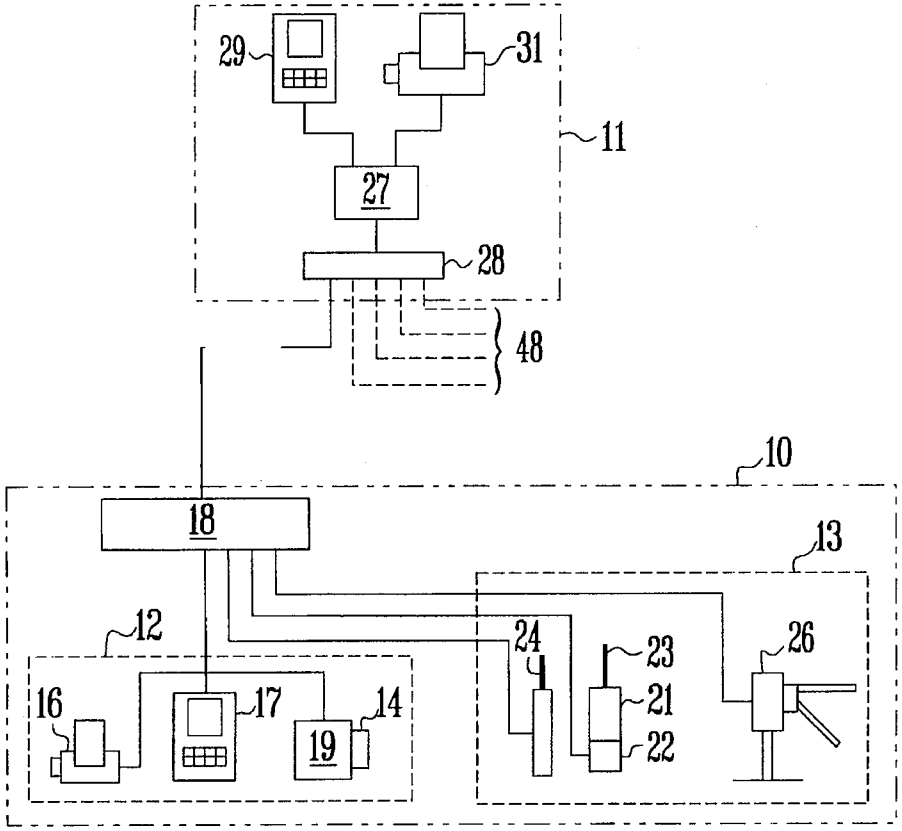

FIG. 1 is a block diagram of a local access control device for a vacation site having several entrances whose local computers are connected with a central computer; and FIG. 2 is the schematic circuit diagram of the control pass that forms the portable part of the device.

Figure 3:
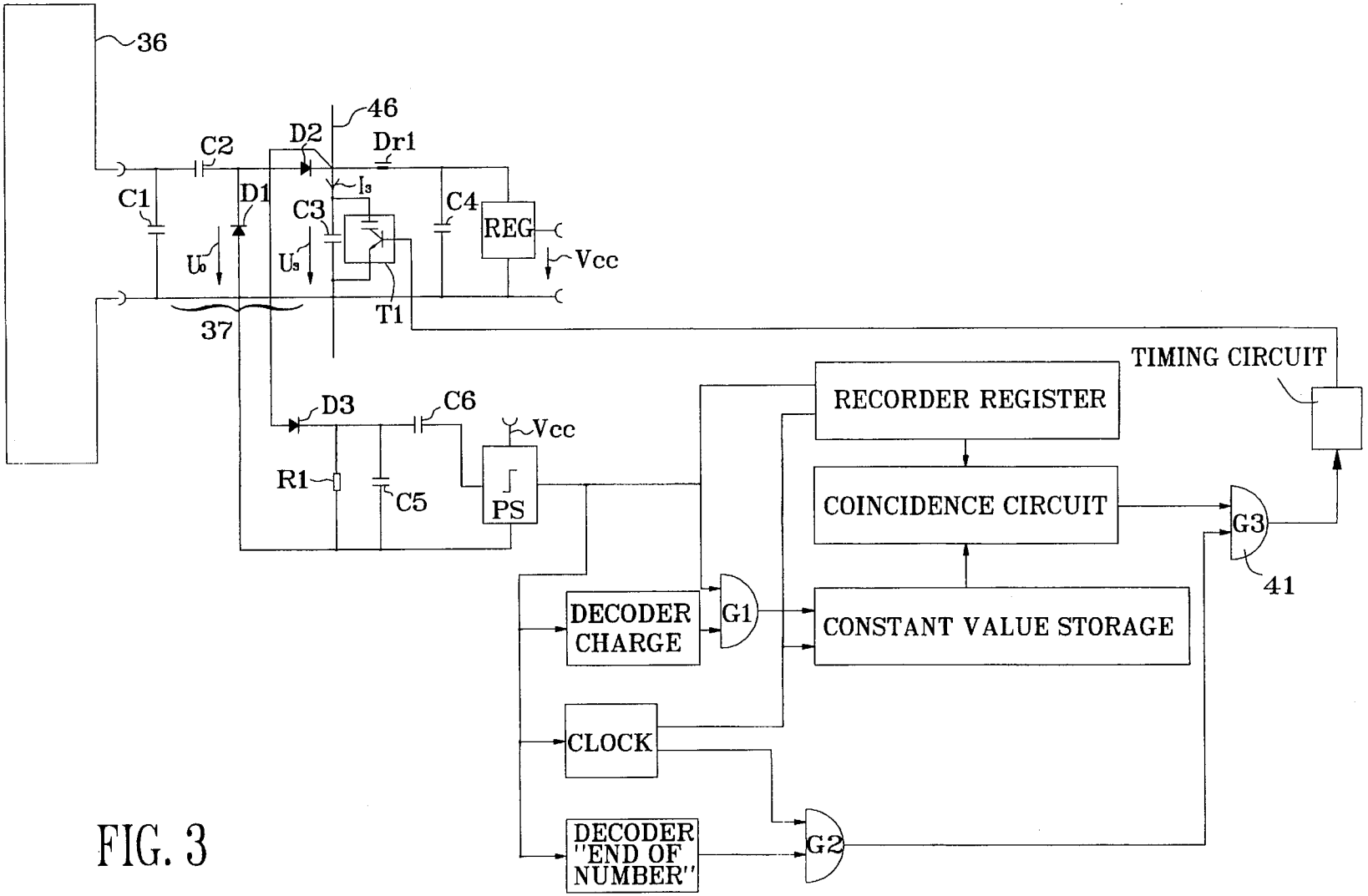

FIG. 3 electronic circuit schematic of a sample design of the ID.

DESCRIPTION OF THE PREFERRED EMBODIMENT

The access control device shown in FIG. 1 includes a local control device 10 connected to a central control device 11. The central control device has provisions for connecting further local control devices (not shown in FIG. 1) and enables control and processing of events at the individual local control devices as well as coupling them together. The shown local control device has two parts: a sales point 12 for issuing passes that permit access to the site and a lockable site entrance 13 that can be opened with a valid pass to admit one person.

The sales point 12 includes a data terminal 14 for one person permitting input of all relevant data for a particular pass to be issued, as, for example, the length of time and area of validity. The sales point also contains a printer 16 and an operator terminal 17 that can display all the data needed by the operator. The data terminal, the printer and the operator terminal are all connected to a local computer 18 which stores and processes the data supplied by the above-named apparatus. Connected to the local computer is a programming and issue machine controlled by the local computer that stores at least one individual ID number in the ROM of each pass to be issued, in a manner [yet] to be described below.

The lockable entrance 13 of the device includes an HF transmitter 21 with an associated modulator 22 and a transmitter antenna 23. Further included with this entrance is a receiver antenna 24 and a turnstile 26 with an electrically controllable locking and unlocking mechanism.

The modulator of the HF transmitter, the receiver antenna and the locking and unlocking mechanism of the turnstile are also connected to the local computer.

The central control device 11 contains a central computer 27 connected to the local computer 18 (and further local computers not shown) via a selecting modem 28 and equipped with a display terminal 29 and a printer 31.

The schematic circuit diagram of a control pass shown in FIG. 2 contains a receiver antenna 36 connected to the input of an HF receiver 37 and a rectifier circuit 38 used for power supply. The output of the HF receiver is connected to the input of a demodulator 39 and to one input of a gate circuit 41. A line from the demodulator leads to the input of a comparator circuit 42, the other input of which is connected to a ROM 43.

A line from the comparator circuit leads to the other input of the gate circuit whose output is connected to an oscillator 44, for simplicity a Gunn diode, whose own output goes to a transmitter antenna 46. The entire control pass has the format of a credit card and consists of a plastic substrate 47 on which is deposited a layer of suitable semiconductor material in which all components, electronic circuits and conductors are embodied, for example by planar epitaxial technique.

There will now be described the use and operation of the device according to the invention using the example of controlling access to a recreational site having several local control devices, such as a regional skiing area with several transport system. Priorto entry, a visitor to such a site stops at the sales poiint 12 where an operator uses the terminal 17 to key in data showing for which authorized entrances and which different installations the pass to be issued is intended. These data are stored and processed in the local computer. teh computer then assigns an ID number, for simplicity the serial number of the pass to be issued and controls the programming and issue machine 19 which writes the same number into the ROM 43 of the pass and issues thepass.

The Local computer 18 also controls the modulator 22 of teh locally fixed transmitter 21, whose carrier freqency is modulated with the continuous sequence of all valid ID numbers.

When the user carrying the pass comes within the transmitting range of the locally fixed tranmitter 21, the modulated HF signal received by the antenna 36 of the control pass goes to the portable receiver 37 and to the current supply circuit 38. The received, modulated HF signal is input to the demodulator 39. The output of the demodulator 39 provides a continuous sequence of all the valid ID numbers with which the carrier frequency of the transmitter has been modulated. These ID numbers are compared in the comparison circuit 42 with an assigned ID number stored in a constant value storage device or ROM. As soon as the comparison circuit establishes a coincidence of a ID number of the sequence with an ID number stored in the constant value storage device, an output signal is generated which is input to the gate circuit as a control signal. When both the control signal and the demodulated sinal from the portable receiver are output together, an excitation signal is fed to the oscillator 44. The high frequency produced by the oscillator 44 is then broadcast by the transmitter antenna 46 built into the contorl pass.

The locally fixed receiving antenna 24, disposed in the immediate vicinity of the turnstile 26, transfers the signal radiated by the portable transmitter antenna to the computer 18 which activates the unlocking mechanism of the turnstile 26 to permit the entry of one person and also records that entry.

The local control device shown in FIG. 1 is connected to a central system 11 to which further local control devices not shown are attached, as suggested by the dashed lines 48. Each local computer transmits all stored data to the central computer which sends these data to those local computers for which the ID number of a pass obtained at any issuing station is valid.

The above-described and illustrated, much-simplified embodiment of the device according to the invention can be constructed in a variety of ways and adapted to special requirements.

For example, the issue point 12 may contain, in addition to the described data terminal and programming and issue machine, a video camera to produce an electronically processable picture of the pass holder. The printer can make a visible imprint of the issue date and the term of validity of the pass as well as the type of pass, i.e., whether it is intended for foreign or domestic users, for adults or children, for a single person or a group, etc. The data common to all passes can be pre-programmed in the programming and issue machine simply by means of a plug-in module. However, instead of programming the passes in the programming and issue machine, it is possible to use passes with ROMs into which an individual ID number was read by the manufacturer and also printed on the pass. In that case, only manual entry of the ID number of such a pass into the operator terminal is required prior to issue.

Passes that are valid for a long time or which should be used to gain access to installations controlled by a human being, e.g., a sub-installation, can be imprinted with the digitally processed picture of the holder taken by the video camera.

Furthermore, other devices than the described HF transmitters and receivers can be used for signal transmission, e.g., optical and preferably infrared or magnetic systems.

It is sensible to program the local computer in such a way that repeated opening of a lockable entrance is possible only after the expiration of a pre-settable waiting period so as to prevent the use of one pass by several persons. The central computer makes possible not only the interconnection of several local computers but also, especially, the creation of a printable log showing at which issue point a pass was sold and which entrances are to be used with it. Such a log also makes it possible to show how the monies received by all sales points of a regional installation relate to entries at the individual local sites, i.e., to the work product of these sites.

It is also possible to provide individual, lockable site entrances within a regional installation but without an associated sales point and to connect the central and local control devices by either cable or radio.

Finally, the use of the access control device according to the invention is not limited to the described example of a recreation site, but may be used with equal merit for controlling and guarding the access to individual departments in a factory or a commercial enterprise, in military installations or in administrative centers.

The theoretical circuit of an ID, shown in FIG. 2, contains a receiving antenna 36, an HF receiver 37, a stabilizer 38 used for current supply, and logical components. The theoretical operation is described below.

The HF signal received from antenna 36 reaches, on the one hand, stabilizer 38, which rectifies and stabilizes the high-frequency signal and thus supplies the supply voltage for the electronic components of the ID. On the other hand, the antenna signal reaches the input of a HF receiver 37. The output of the HF receiver is connected to the input of demodulator 39 and to the input of gate circuit 41. The information arriving from the demodulator is compared in comparator circuit 42 with the information contained in read-only storage 43. If the comparator circuit finds that the two data are identical, an output signal goes from comparator circuit 42 to gate circuit 41. This causes gate circuit 41 to open and activate oscillator 44 which, in turn, emits a HF signal from transmission antenna 46, connected to oscillator 44 and integrated into the ID.

A preferred design of an ID for the access-control device is shown in FIG. 3. The structure of the electronic circuit has three components, namely, first, a HF part with receiving antenna 36, receiving part 37, oscillator 44, and transmitting antenna 46; second, a current-supply part; and third, a digital logic circuit. The loop antenna, tuned to a fundamental frequency of of 27 MHz and featuring a length of 80 mm and a width of 50 mm, is tuned with a capacitor C1 of 100 pF.

Assuming that about 10,000 IDs are in simultaneous circulation; that there is a requirement that the identifying process for an ID last at most one second; and that each ID contains an identification of 64 bits, there results a transfer rate of 640,000 bits per second (640 kbit/sec); accordingly, the minimum base frequency must be 3.2 MHz. In addition, a start- and a stop-code must be co-modulated at the beginning and at the end of each identification word.

For the ID described herein, a higher base frequency, 27 MHz, is used. The E-current supply for the operation of the ID's electronic elements is provided by the electromagnetic energy radiated by transmitter 21. For that purpose, the signal arriving from the antenna is fed to the voltage regulator, via coupling capacitor C2 of 30 pF and an impedance Drl of 10/uH. The output of the voltage regulator supplies the supply-voltage $v_{cc}$, required by the electronic elements.

At the same time the antenna signal is amplified via the voltage doubler which consists of diodes D1 and D2 and capacitor C3 (15 pF). Next, this analog HF signal is demodulated and the resultant digital signals reach the logical part of the circuit. The demodulated signals, which represent a bit sequence of all valid identification numbers, are processed in the logical circuit in accordance with the methods commonly used in logic-circuit technology.

If the logic finds that a transmitted characteristic number is identical with the number stored in the read-only storage of the ID, the oscillator is activated. The bipolar transistor T1 then becomes conductive and the voltage, raised via capacitor C3, thus gains a harmonic spectrum. The built-in reflector antenna 46 is tuned to the predetermined harmonic of the carrier base frequency, for example, by being dimensioned on this harmonic spectrum as a dipole for a frequency of 3f, with an antenna length of two times 40 mm, and radiates the HF, which is received by antenna 24 at the entrance control.

As long as there is no matching of the transmitted identification numbers with the identification number stored in the read-only storage of the ID, the oscillator is not activated—i.e., transistor T1 is blocked. In such a state, the harmonic content of the voltage on capacitor C3 is practically nil.

In this design of the ID, the characteristic number is either stored in the read-only storage by the manufacturer, or the identification number of the ID is only stored in the read-only storage upon issuance of the ID. In the former case, the identification number may contain a consecutive card number and an installation code. If the ID is only coded when issued, the storage of the identification number in the read-only storage is carried out via high frequency. In addition to the identification number to be stored, a loading code is transmitted. When the logic in the ID recognizes such a loading signal, the ID data are transferred to the read-only storage.

The entire ID has the format of a credit card and consists of a plastic-material carrier 47 on which the electronic components and conducting paths are applied by the epitaxial-planar technique, using conventional procedures, for example, by liquid-phase epitaxial deposition of semiconductor layers on a substrate.

While having been described in terms of a preferred embodiment of an access-control system featuring a powerless, portable control pass, the invention clearly also has broader application, for example for a garage-door opener (a form of access control, of course), a remote car-unlocking unit or a TV remote.

More broadly stated, the invention provides, in combination, a remotely actuated, switchable, powered apparatus actuatable by a powerless, hand-held control unit, said switchable apparatus comprising:

switch means to actuate said powered apparatus;

a system-based HF transmitter outputting an HF carrier wave of predetermined frequency modulated with a control-unit input signal;

a system-based HF receiver operating said switch means upon reception of a pre-settable unlock signal; and a local computer in which a range of valid ID numbers is stored;

a portable, powerless, hand-held control unit responsive to said HF carrier wave signal to provide a control output signal, said control unit comprising:

a) a receiver tuned to said predetermined HF carrier wave frequency to receive said modulated carrier wave;

b) a current-drawing circuit coupled with said receiver to draw power from said carrier wave;

c) an amplifier to provide an amplified output from said input signal; and d) signal-processing means employing said input signal together with a control-unit derived signal to derive and output a control signal, said amplifier and said signal-processing means being powered by said current-drawing circuit; and e) a transmitter antenna to transmit said control signal.

The invention also extends to a control unit which can, in one embodiment, be an element of the aforesaid combination, and can be used as the control pass of the access control system described herein, with reference to the accompanying drawings. To this end, the invention provides a portable, powerless, interactive, radiowave-actuated, hand-held, remote control unit responsive to an HF carrier wave signal of predetermined frequency to provide a control output signal, said carrier wave being modulated with an input signal, said control unit comprising:

a) a receiver tuned to said predetermined HF carrier wave frequency;

b) a current-drawing circuit coupled with said receiver circuit to draw power from said carrier wave;

c) an amplifier to provide an amplified output from said input signal; and d) signal-processing means employing said input signal together with a control-unit-derived signal to output a control signal, said amplifier and said signal-processing means being powered by said current-drawing circuit; and e) a transmitter antenna to transmit said control signal.

For situations where it is undesirable to transmit a continuous HF signal from the switchable apparatus, the control unit may be equipped with a low-level power source, for example a microbattery, a solar cell or a capacitative charge, sufficient to drive an apparatus-based transmitter-actuating control output from the control unit. Once the control unit succeeds in actuating the apparatus-based transmitter, for example with a crude timed, or pulsed, oscillator signal, the control unit can then draw signal-processing current from the apparatus-based HF output. Such transmitter-actuating signal needs initiating, for example by user contact or manual action on a key, button or other pressure-sensitive means built into the control unit.

Development of such touch- or pressure-sensitive means into a range of user-activatable selection points providing a control-unit-derived signal for processing into a simple coded output, for example, digitized or pulsed or both. Such development enables the inventive control unit to be realized as, for example, a nearly powerless remote control unit for the other uses mentioned above, for example, garage-door opener, car-unlocking, and TV or VCR remote (or both). A completely powerless unit for TV or VCR can be initiated by manually switching on the TV or VCR apparatus, and then, using the remote, which draws power from a TV- or VCR-based HF carrier output to change channels or volume or to shut down the system. The advantage is a small, battery-less remote control unit.

I claim:

1. An access control system activatable by coded access passes, said access control system comprising:

a) at least one local access control device including a system-based transmitter broadcasting an H.F. carrier output signal comprising a repeated sequence of valid ID codes, a locking mechanism and a system-based receiver, said locking mechanism being remotely activatable by a control signal received by the receiver; and b) a number of batteryless, portable control passes, each said control pass being coded with an assigned ID code and capable of remote activation of said local control device, and comprising:

i) a built-in receiver with antenna to receive said carrier signal;

ii) a memory storing said assigned ID code;

iii) a comparator circuit to compare said assigned ID code with said transmitted series of valid ID codes;

iv) a built-in transmitter responsive to said comparator circuit to emit said control signal when said comparator circuit detects correspondence between said assigned ID code and an ID code from said sequence of valid codes output by said system-based transmitter; and v) a current-drawing circuit coupled with said receiver circuit to draw power from said broadcast signal, said ID pass being otherwise powerless;

whereby a control pass bearing a valid assigned ID code, as determined by said comparator circuit, can respond to receipt of said carrier signal, while said control pass is remote from said system-based receiver, by emitting said control signal to activate said locking mechanism and permit access by a bearer of said pass.

2. An access-control system according to claim 1 wherein each said control pass has a credit-card like conformation, and said receiver includes a loop antenna extending substantially around a periphery of said portable pass to maximize the extent of said loop antenna.

3. An access pass according to claim 2, wherein said control pass transmitter antenna is a directional, high-frequency, reflector antenna with an antenna length which is a dipole for a harmonic of the carrier wave frequency.

4. An access control system according to claim 1 wherein said control signal is an oscillator-generated actuator signal common to each said pass and each said control pass includes an oscillator circuit capable of generate said control signal at a presettable frequency.

5. An access-control system according to claim 1 wherein said portable control pass is embodied in card format having a substrate layer and having components, circuits and connections deposited in at least one semiconductor layer on said substrate.

6. An access pass according to claim 1 wherein said broadcast signal is an HF signal with a base frequency related to a total number of valid ID codes which frequency is high enough to transmit said valid ID codes in one second.

7. An access control system according to claim 1 wherein said locking mechanism includes a turnstile admitting one person at a time, wherein said local control device and said portable pass have a communication range such that only said one person can actuate said lock mechanism.

8. An access-control system according to claim 1 said access-control system being for a recreational center having a plurality of closable site entrances, wherein said access-control system comprises a plurality of said local access-control devices, one for each said closable site entrance whereby each said closable site entrance has a local computer, said access-control system further comprising a central computer communicating with said local computers to co-ordinate said valid ID ranges and maintain a centralized ID database.

9. A portable, transceiving, batteryless, remote-control access pass responsive to an H.F. carrier broadcast signal of predetermined frequency and character to emit a control signal recognizable at an access control station to automatically permit access to a bearer of said pass, said broadcast signal comprising a repeated sequence of valid ID codes, said portable pass comprising:

a) a receiver circuit tuned to said broadcast signal predetermined frequency;

b) an amplifier to provide an amplified output from said broadcast signal;

c) a pass ID code stored in permanent memory on said pass;

d) a comparator circuit to compare said stored pass ID code with said valid ID codes from said input signal and generate an output signal in response to a match; and e) an oscillator circuit generating said control signal in response to said comparator output signal;

f) a transmitter to emit said control signal; and g) a current-drawing circuit coupled with said receiver circuit to draw power from said broadcast signal said ID pass being powerless.

* * * * *